US006591077B2

(12) United States Patent
Yanagisawa et al.

(10) Patent No.: US 6,591,077 B2
(45) Date of Patent: Jul. 8, 2003

(54) IMAGE FORMING APPARATUS AND TONER CONTAINER THEREFOR

(75) Inventors: Takaaki Yanagisawa, Tokyo (JP); Tomotoshi Nakahara, Kawasaki (JP); Masumi Sato, Yokohama (JP); Kazuhisa Sudo, Kawasaki (JP); Yoshio Hattori, Kawasaki (JP); Kouta Fujimori, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/848,320

(22) Filed: May 4, 2001

(65) Prior Publication Data

US 2001/0051062 A1 Dec. 13, 2001

(30) Foreign Application Priority Data

May 8, 2000 (JP) ..... 2000-134765
May 18, 2000 (JP) ..... 2000-145948
Mar. 21, 2001 (JP) ..... 2001-080727

(51) Int. Cl.[7] ..... G03G 15/08
(52) U.S. Cl. ..... 399/258; 222/DIG. 1; 399/262
(58) Field of Search ..... 399/252, 254, 399/258, 256, 262, 268, 101, 119, 120, 301; 222/1, DIG. 1, 167; 141/268, 18, 28

(56) References Cited

U.S. PATENT DOCUMENTS

| | | | | | |
|---|---|---|---|---|---|
| 4,304,273 | A | * | 12/1981 | Caudill et al. | 141/268 |
| 5,142,335 | A | * | 8/1992 | Sakata et al. | 399/106 |
| 5,207,353 | A | * | 5/1993 | Corby et al. | 222/1 |
| 5,245,385 | A | | 9/1993 | Fukumizu et al. | 399/91 |
| 5,289,147 | A | | 2/1994 | Koike et al. | 399/1 |
| 5,311,265 | A | * | 5/1994 | Miller | 399/106 |
| 5,339,141 | A | | 8/1994 | Suzuki et al. | 399/285 |
| 5,367,363 | A | | 11/1994 | Kai et al. | 399/113 |
| 5,400,123 | A | | 3/1995 | Sato et al. | 399/187 |
| 5,424,814 | A | | 6/1995 | Suzuki et al. | 399/286 |
| 5,426,492 | A | * | 6/1995 | Diehl | 399/262 |
| 5,440,373 | A | | 8/1995 | Deki et al. | 399/113 |
| 5,508,795 | A | * | 4/1996 | Kikuchi | 399/262 X |
| 5,512,984 | A | | 4/1996 | Kimura et al. | 399/228 |
| 5,515,145 | A | | 5/1996 | Sasaki et al. | 399/302 |
| 5,537,197 | A | | 7/1996 | Fujishiro et al. | 399/228 |
| 5,565,973 | A | | 10/1996 | Fujishiro et al. | 399/227 |
| 5,583,630 | A | | 12/1996 | Kimura et al. | 399/227 |
| 5,610,692 | A | * | 3/1997 | Trask et al. | 399/262 X |
| 5,621,221 | A | | 4/1997 | Shinohara et al. | 250/276 |
| 5,630,195 | A | | 5/1997 | Sawayama et al. | 399/49 |
| 5,648,842 | A | | 7/1997 | Sekine et al. | 399/350 |

(List continued on next page.)

FOREIGN PATENT DOCUMENTS

| | | | |
|---|---|---|---|
| EP | 0 675 416 | | 10/1995 |
| EP | 0 844 537 | | 5/1998 |
| EP | 1 014 214 | | 6/2000 |
| FR | 2 767 393 | | 2/1999 |
| JP | 04-184464 | * | 7/1992 |
| JP | 10-333412 | | 12/1998 |
| JP | 11-102108 | | 4/1999 |
| JP | 2000-81778 | | 3/2000 |
| JP | 2000-194182 | | 7/2000 |

*Primary Examiner*—Hoan Tran
(74) *Attorney, Agent, or Firm*—Oblon, Spivak, McClelland, Maier & Neustadt, P.C.

(57) ABSTRACT

An image forming apparatus of the present invention includes a mount portion in which a toner container is expected to be set from above. When the toner container set in the mount portion runs out of toner, a spring causes the toner container to hop up away from a position where it is set. This promotes easy handling of the toner container in a limited space available in the apparatus.

24 Claims, 15 Drawing Sheets

U.S. PATENT DOCUMENTS 5,652,944 A * 7/1997 Masuda et al. ..... 399/262 X
5,655,193 A 8/1997 Fujishiro et al. ..... 399/256
5,671,465 A 9/1997 Kimura et al. ..... 399/119
5,737,665 A 4/1998 Sugiyama et al. ..... 399/39
5,761,570 A 6/1998 Sawayama et al. ..... 399/49
5,765,083 A 6/1998 Shinohara ..... 399/301
5,839,032 A 11/1998 Yasui et al. ..... 399/381
5,860,038 A 1/1999 Kato et al. ..... 399/49
5,875,380 A 2/1999 Iwata et al. ..... 399/301
5,899,597 A 5/1999 Shinohara et al. ..... 399/64
RE36,301 E 9/1999 Kai et al. ..... 399/113
5,953,568 A 9/1999 Fujishiro et al. ..... 399/267
5,960,238 A * 9/1999 Ohgami ..... 399/258
5,962,783 A 10/1999 Iwata et al. ..... 73/488
5,963,240 A 10/1999 Shinohara et al. ..... 347/116
6,014,536 A * 1/2000 Ban et al. ..... 399/258
6,055,386 A 4/2000 Kato et al. ..... 399/49
6,070,030 A 5/2000 Fujishiro ..... 399/111
6,112,047 A 8/2000 Kato et al. ..... 399/405
6,118,557 A 9/2000 Sugiyama et al. ..... 358/504
6,122,468 A 9/2000 Sakamoto et al. ..... 399/223
6,125,257 A 9/2000 Sekine et al. ..... 399/343
6,128,459 A 10/2000 Iwata et al. ..... 399/301
6,134,418 A 10/2000 Kato et al. ..... 399/381
6,160,569 A 12/2000 Fujimore et al. ..... 399/50 X
6,249,304 B1 6/2001 Sawayama et al. ..... 347/228
6,263,185 B1 7/2001 Kato et al. ..... 399/124
6,282,396 B1 8/2001 Iwata et al. ..... 399/301
6,289,193 B1 * 9/2001 Ban et al. ..... 399/258
6,295,435 B1 9/2001 Shinohara et al. ..... 399/301
6,295,438 B1 9/2001 Fujishiro et al. ..... 399/346
6,308,027 B1 10/2001 Obu et al. ..... 399/110
6,380,960 B1 4/2002 Shinohara ..... 347/116
6,381,435 B2 4/2002 Shinohara et al. ..... 399/301

* cited by examiner

IMAGE FORMING APPARATUS AND TONER CONTAINER THEREFOR

BACKGROUND OF THE INVENTION

The present invention relates to an image forming apparatus, particularly a printer, facsimile apparatus or similar electrophotographic image forming apparatus, and a toner container therefor. Further, the present invention relates to a toner conveying pump including a tubular stator formed with a spiral groove and a rotor spirally extending such that a space for conveying toner is formed between the stator and the rotor.

It is a common practice with an image forming apparatus to use a toner container storing toner and implemented as a cartridge, bottle or similar hard container. The hard toner container, however, brings about various problems when replaced and discarded. In light of this, a bag-in-box type toner container made up of a deformable bag and a rigid box accommodating the bag therein has been proposed. The bag is implemented by a resin, paper or similar flexible sheet and can have its volume reduced, as needed. A powder pump, for example, stably replenishes toner from the toner container to a developing device remote from the toner container. The toner container is mounted to the apparatus with its mouth facing downward.

The toner container can be positioned on the image forming apparatus without regard to the position of the developing device. Therefore, when the toner container is applied to a full-color image forming apparatus, a plurality of toner containers should naturally be arranged in the apparatus side by side from a mechanical design standpoint. In this case, the toner containers should preferably adjoin each other at a minimum of distance in order to save a limited space available in the apparatus.

However, the problem with the arrangement described above is that the toner containers adjoining each other are difficult to handle. This is true even when each toner container is sized small enough for a person to handle it by one hand. While this problem may be solved if a handle is provided on the top of the box of each toner container, the handle that needs a certain degree of strength increases the cost to a noticeable degree.

A toner conveying pump for use in an image forming apparatus includes a stator and a rotor configured to form a space for conveyance therebetween. The rotor in rotation conveys toner present in the above space. A problem with the conventional toner conveying pump is that the toner in the space is heavily compressed and therefore subject to heavy stress. In addition, friction acting between the rotor and the stator heats the inside of the pump and therefore the toner whose melting point is relatively low. The stress and heat are apt to cause the toner to cohere and form a number of lumps as small as about 1 mm. Assume that the toner including such lumps is conveyed to a developing device for forming a toner image on an image carrier. Then, when the toner image is transferred to a paper sheet or similar recording medium, portions of the toner image around the lumps on the image carrier fail to closely contact the paper sheet. As a result, the toner image transferred to the paper sheet includes small toner spots and blank portions around the toner spots. This lowers the quality of the toner image to a critical degree.

Technologies relating to the present invention are disclosed in, e.g., Japanese Patent Laid-Open Publication Nos. 10-333412, 11-102108, 2000-81778, and 2000-194182.

SUMMARY OF THE INVENTION

It is a first object of the present invention to provide an image forming apparatus allowing a toner container to be easily mounted thereto from above without resorting to a handle, and the toner container.

It is a second object of the present invention to provide a toner conveying pump capable of effectively preventing toner from cohering in the form of lumps.

It is a third object of the present invention to provide an image forming apparatus capable of reducing the undesirable small toner spots and blank portions therearound in a toner image transferred to a recording medium.

In accordance with the present invention, an image forming apparatus includes a body and a mount portion included in the body for allowing a toner container storing toner to be mounted from above. A releasing device releases the toner container from a position where it is set in the mount portion.

Further, in accordance with the present invention, in a toner container storing toner and to be removably mounted to a mount portion included in an image forming apparatus. The toner container is mounted to the mounted portion from above and released from the mount portion upward.

Moreover, in accordance with the present invention, an image forming apparatus includes a mount portion for allowing a toner container, which stores toner, to be removably mounted from above for thereby replenishing the toner to a developing device. A nozzle extends upward from the mount portion. A shutter device is included in the toner container and closed by a resilient member that exerts a force outward of the toner container. A pushing member pushes the toner container set in the mount portion upward. The force of the resilient member is used as a biasing force of the pushing member.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiments of the image forming apparatus and a toner container in accordance with the present invention will be described hereinafter.

First Embodiment

This embodiment, as well as a second embodiment to follow, is directed toward the first object stated earlier. To better understand the illustrative embodiment, reference will be made to a conventional toner container, shown in FIG. 1. As shown, four toner containers 20 are arranged side by side in the body 50 of a full-color image forming apparatus. Each toner container includes a bag, not shown, storing toner therein and formed of a resin, paper or similar flexible sheet. The bag is received in a rigid box. The toner containers 20 adjoin each other at a minimum of distance in order to save a limited space available in the apparatus.

However, the problem with the conventional configuration is that the toner containers 20 arranged side by side are difficult to handle. This is true even when each toner container 20 is sized small enough for a person to handle it by one hand. While this problem may be solved if a handle is provided on the top of the box of each toner container 20, the handle that needs a certain degree of strength increases the cost to a noticeable degree, as stated earlier.

Figure 1:
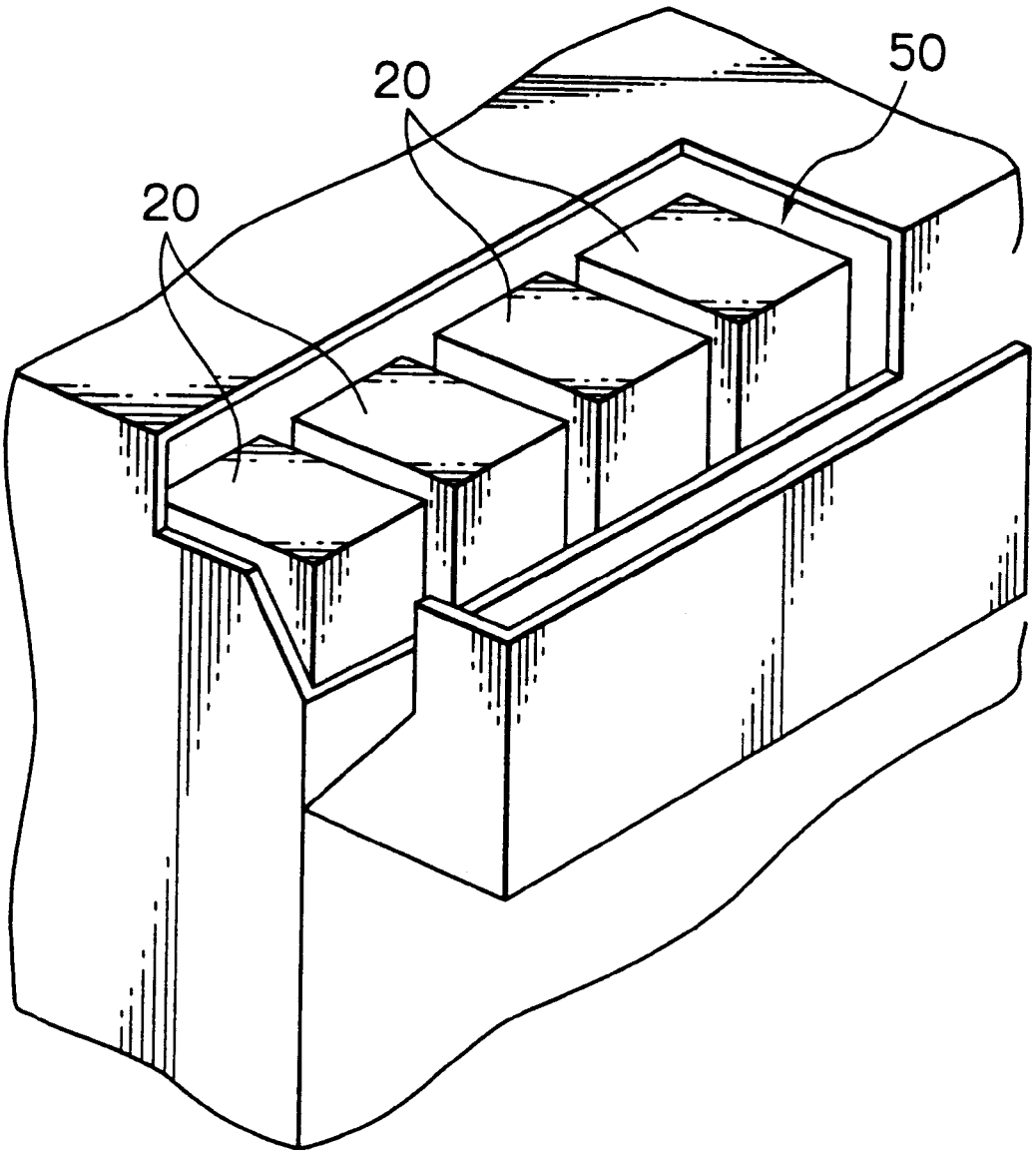
Fig. 1 PRIOR ART
FIG. 1 is an isometric view showing a specific configuration of a mount portion included in an image forming apparatus to which the present invention is applicable.
Figure 2:
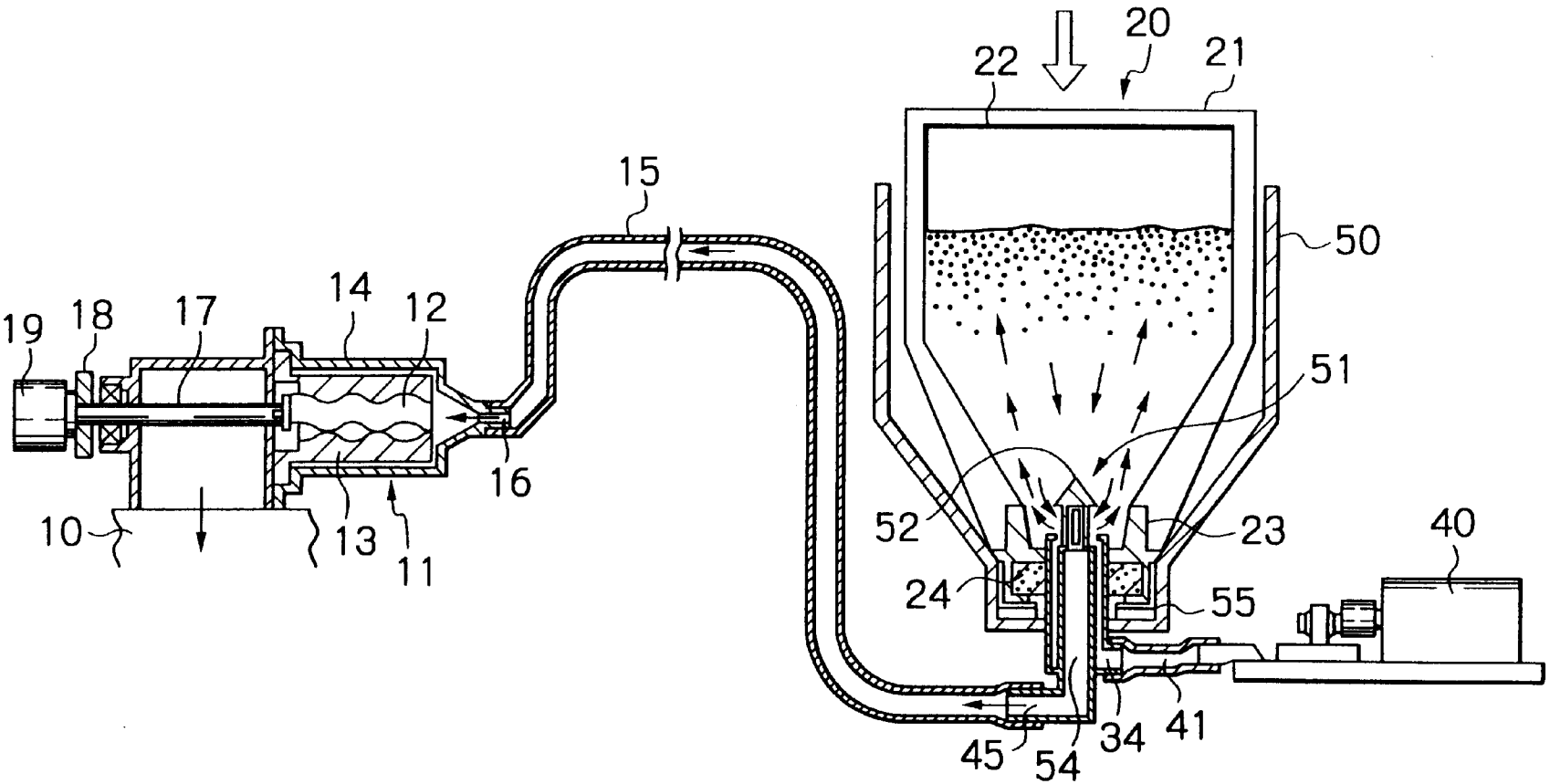
FIG. 2 is a view showing a toner replenishing device included in a first embodiment of the image forming apparatus in accordance with the present invention.
Figure 3:
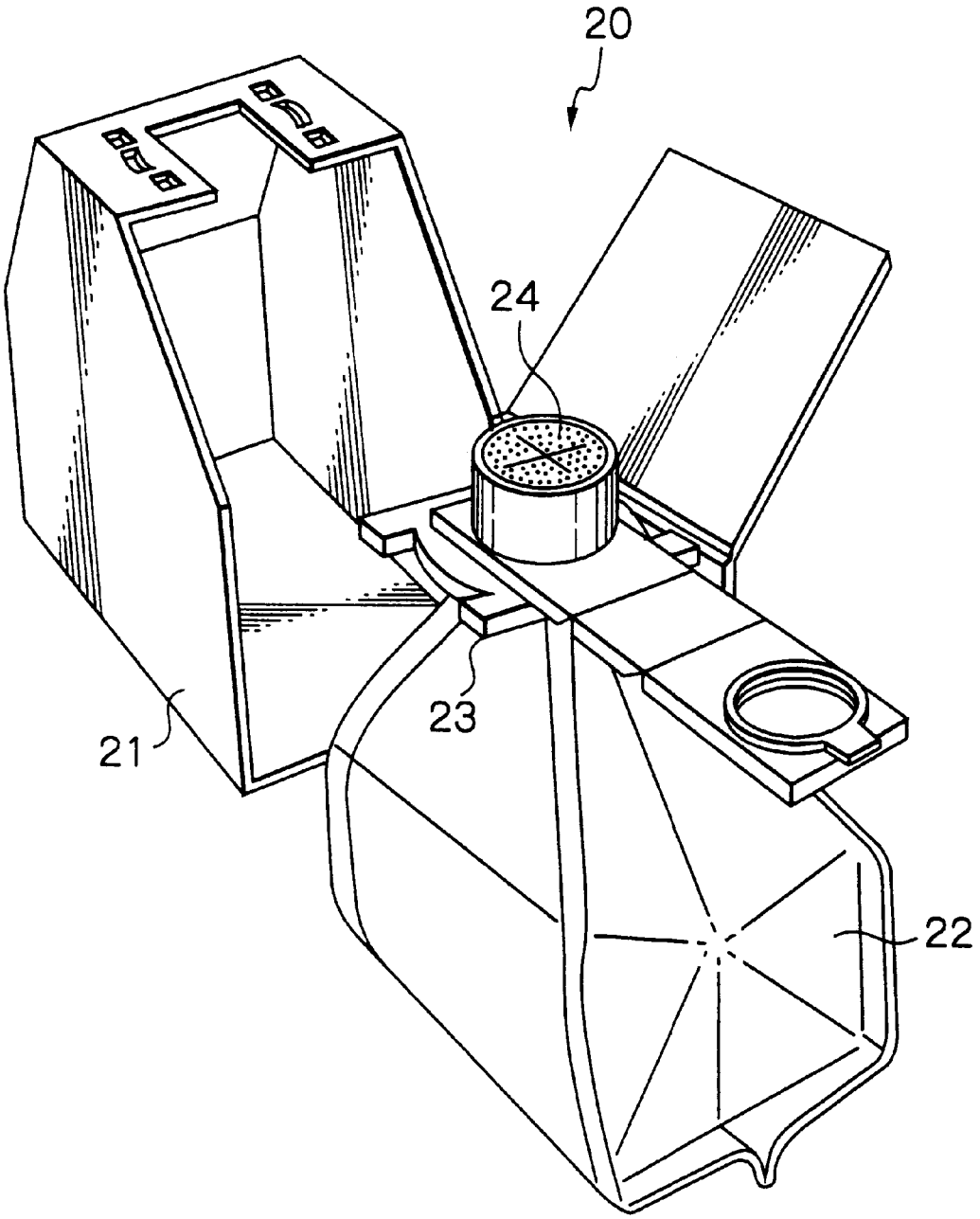
FIG. 3 is an isometric view of a toner container included in the illustrative embodiment, as seen from the bottom.

Referring to FIG. 2, a toner replenishing device included in the illustrative embodiment is shown. FIG. 3 shows a specific configuration of a bag-in-box type toner container also included in the illustrative embodiment. As shown, a toner container 20 is removably set on a mount portion 50 included in the body of an image forming apparatus and independent of a developing device 10. The toner container 20 is made up of a deformable bag 21 storing toner and a box 22 receiving the bag 21 and more rigid than the bag 21. As shown in FIG. 1, the mount portion 50 may be so positioned as to appear when the door or cover of the apparatus body is opened or may be mounted on the outside of the apparatus body.

The toner container 20 is mounted to the mount portion 50 from above the apparatus body. A nozzle 51 extends upright from the mount portion 50 so as to penetrate into the toner container 20. A conical tip member 52 is molded integrally with or adhered to the top of the nozzle 51. The nozzle 51 has a double wall structure. Specifically, an air inlet passage 55 and a toner outlet passage 54 are formed in the nozzle 51 and communicated to the tip member 52. The toner outlet passage 54 is bent to the left, as viewed in FIG. 2, at the bottom of the nozzle 51 and terminates at a toner outlet 45. The air inlet passage 55 is bent to the right, as viewed in FIG. 2, at a position above the toner outlet 45 and terminates at an air inlet 34.

In the illustrative embodiment, a pipe 41 connects an air pump or air feeding means 40 to the air inlet 34. The air pump 41 feeds air under pressure to the bag 22 of the toner container 20 via the pipe 41 and air inlet passage 55. Air sent into the bag 22 flows through the toner in the bag 22 to thereby fluidize the toner.

A powder pump or single axis, eccentric screw pump 11 is positioned in the vicinity of or constructed integrally with the developing device 10. The powder pump 11 is made up of a rotor or eccentric screw 12, a stator 13, and a holder 14 embracing the rotor 12, stator 13 and holder 14. The rotor 12 is formed of metal or similar rigid material. The stator 13 is formed of rubber or similar elastic member and formed with a double screw. The holder 14 surrounding the rotor 12 and stator 13 forms a powder passage. The rotor 12 is rotated via a gear 18 connected to a drive shaft 17 by a pin joint. A solenoid-operated clutch 19 controls the operation of the powder pump 11. The holder 14 is formed with a suction port 16 at its left end as viewed in FIG. 2. A flexible tube 15 provides fluid communication between the suction port 16 and the toner outlet 45 of the nozzle 51. The tube 15 has a diameter of, e.g., 4 mm to 10 mm and formed of toner-resistant rubber, e.g., polyurethane rubber, nitric rubber, EDPM or silicone rubber. The flexible tube 15 can be laid in any desired direction, i.e., upward, downward, rightward or leftward.

The powder pump 11 is capable of continuously conveying a constant amount of powder, which is precisely proportional to the rotation speed of the rotor 12, with a high solid-to-gas ratio, as well known in the art. In response to a toner replenishment command derived from, e.g., image density sensing, the powder pump 11 starts replenishing a necessary amount of toner to the developing device 1.

FIG. 3 is a view of the toner container 20 with the bag 22 and box 21 being separated from each other, as seen from the bottom. As shown, the bag 22 is implemented by a flexible sheet or a laminate of flexible sheets formed of polyethylene, nylon or similar resin or paper. Each sheet may be about 80 $\mu$m to 120 $\mu$m thick. A mouth member 23 is affixed to the bag 22 and provided with a hermetic structure. The mouth member 23 is formed by, e.g., blow molding and formed with a toner outlet. A seal valve or self-closing valve 24 is fitted in the mouth member 23 and formed of an elastic material, preferably foam sponge. Aluminum may advantageously be deposited on the outer surface or the inner surface of the bag 22 against static electricity or moisture.

The bag 22 has a rectangular parallelepiped shape when inflated. Four faces of the bag 22 are tapered toward the mouth member 23 in their portions adjoining the mouth member 23. The box 22 is formed of resin or paper having a certain degree or rigidity and has a space therein great enough to accommodate the bag 21.

A full-color image forming apparatus uses four toner containers 20 respectively storing yellow toner, magenta toner, cyan toner and black toner. The four toner containers 20 should preferably be set at the mount portion 50 in an array, as shown in FIG. 1. Alternatively, the toner containers 20 may, of course, be arranged in such a manner as to adjoin each other horizontally and vertically. In any case, the toner containers 20 should preferably systematically adjoin each other and should preferably have tops flush with each other.

However, the toner containers 20 arranged in, e.g., the configuration shown in FIG. 1 are difficult to pull out when, e.g., they run out of toner. While a space great enough to accommodate the operator's fingers with a sufficient margin may be provided between nearby toner containers 20, such a space is not practical in consideration of the limited overall space of the apparatus.

Figure 4:
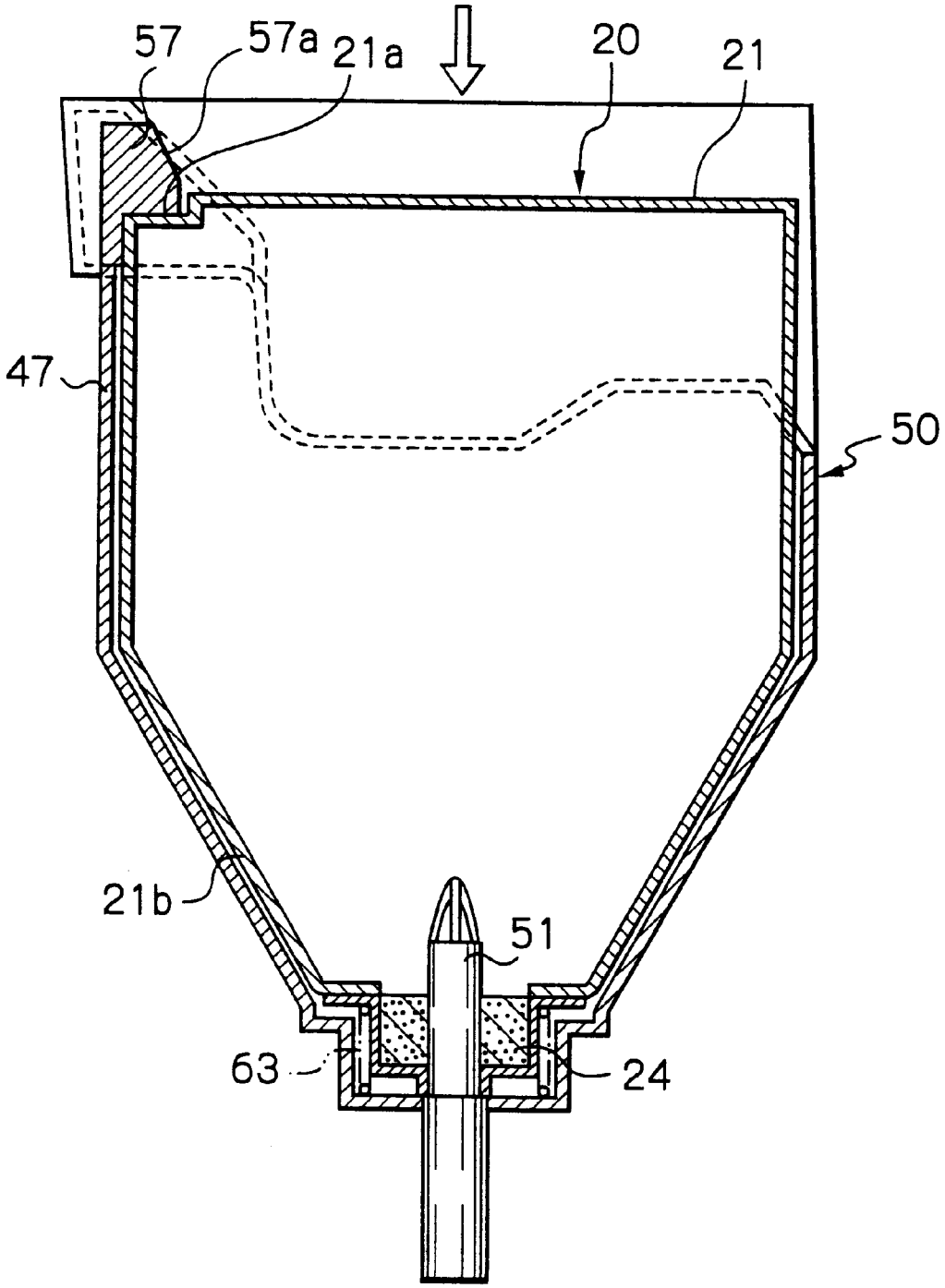
FIG. 4 is a view showing the toner container set in a mount portion.
Figure 5:
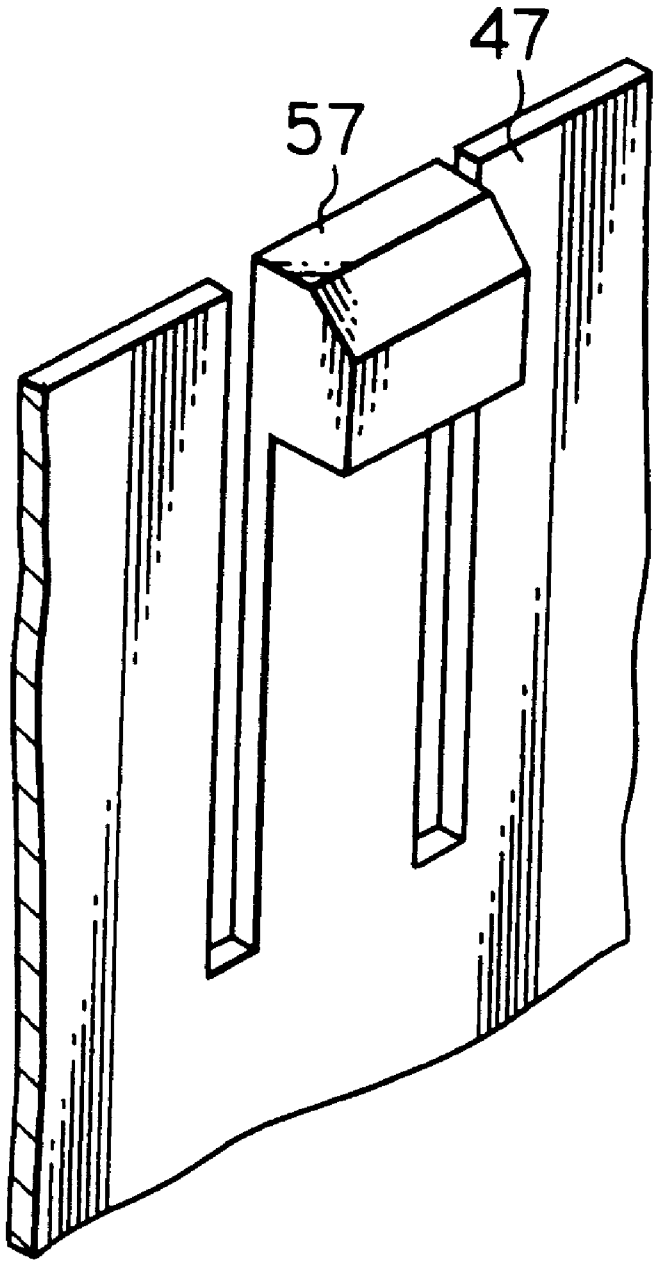
FIG. 5 Is an isometric view showing a specific configuration of a stop included in the illustrative embodiment.

The illustrative embodiment includes means for allowing the operator to pull each toner container 20 upward out of the mount portion 50. Specifically, as shown in FIG. 4, a resilient biasing member or pressing means is mounted on the mount portion 50 for biasing the toner container 20 upward. While the biasing member may be implemented by, e.g., rubber or sponge, the illustrative embodiment uses a compression coil spring 63. The coil spring 63 is fixed in place on the mount portion 50 while surrounding the nozzle 51. A side wall 47 is included in the framework of the apparatus body and forms the mount portion 50. The side wall 47 includes a stop 57 for supporting the toner container 20 accurately set at the mount portion 50. In the illustrative embodiment, as shown in FIG. 5, the stop 57 is molded integrally with the side wall 47. The side wall 47 is implemented by plastic or sheet metal, providing the stop 57 with an adequate degree of elasticity. A recess 21*a* complementary in configuration to the stop 57 is formed on the top of the box 21, so that the stop 57 can abut against the bottom of the recess 21*a*.

Figure 6:
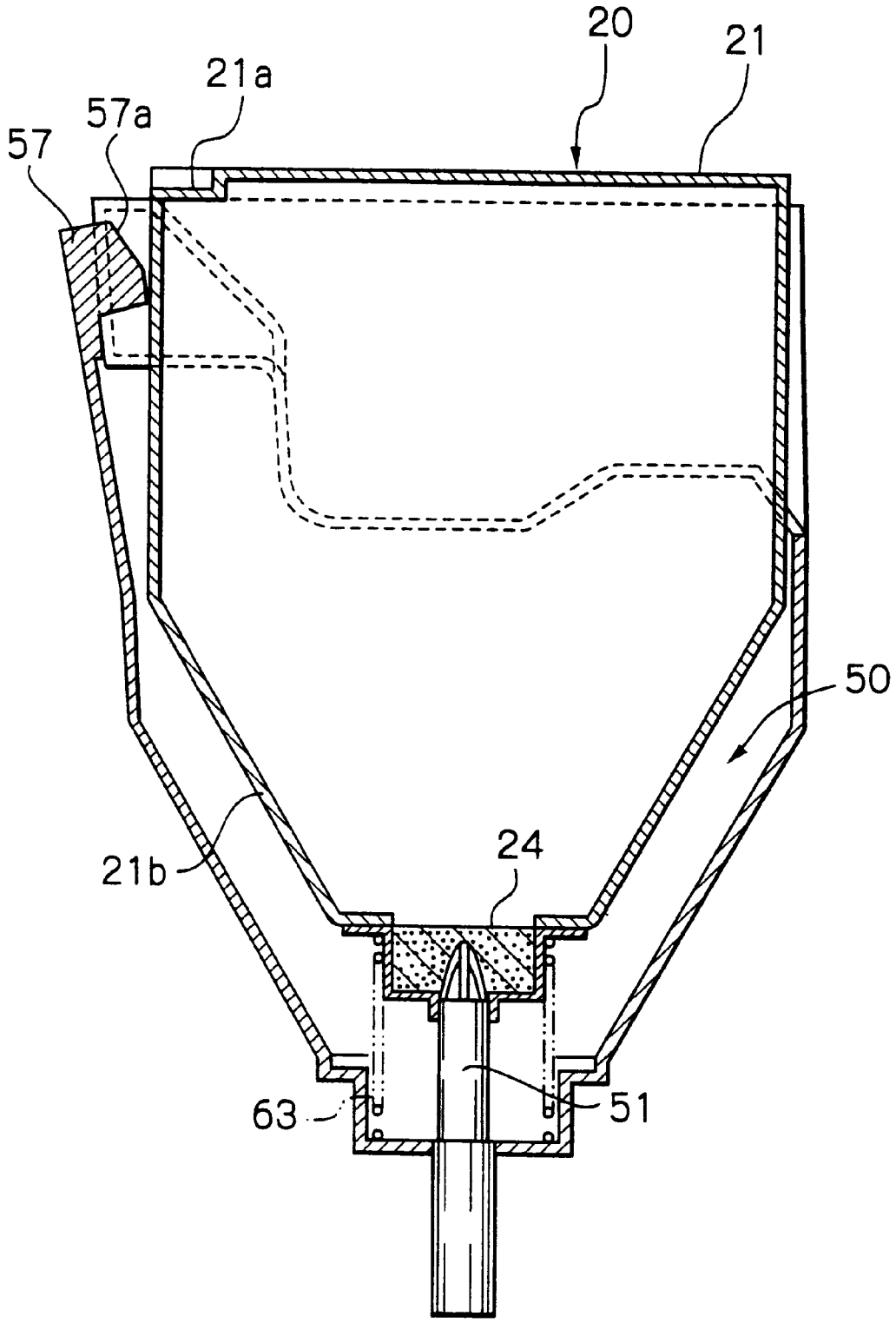
FIG. 6 is a view demonstrating how the toner container is moved.

In operation, when the operator accurately sets the toner container 20 in the mount portion 50, the toner container 20 compresses the spring 63. At this instant, the stop 57 elastically snaps onto the top of the box 21 and abuts against the bottom of the recess 21*a,* locking the toner container 20 in the mount portion 50. To pull out the toner container 20, the operator releases the stop 57 from the top of the box 21. As a result, the spring 63 causes the toner container 20 to hop up, as shown in FIG. 6. In this condition, the toner container 20 is positioned at a higher level than the adjoining toner containers 20 and can therefore be easily pulled out.

The biasing force of the spring 63 will be described specifically hereinafter. The toner container 20 is pulled out of the apparatus body mainly when it has run out of toner. The biasing force of the spring 63 therefore should only be intense enough to push up the empty toner container 20. Assume that resistance F acts on the seal valve 24 when the toner container 20 is pushed up away from the nozzle 51, and that the toner container 20 has a weight M when empty. Then, the biasing force of the spring 63 should only be greater than the sum of F and M. Also, assuming that the toner container 20 has a weight N when full, then the biasing force of the spring 63 can be smaller than the sum of F and N.

The stop 57 includes a tapered surface 57*a* facing the toner container 20 so as not to obstruct the toner container 20 being introduced into the mount portion 50. Further, in the illustrative embodiment, the box 21 includes inclined surfaces 21*b* in its lower portion. If the stop 57 is positioned such that the tapered surface 57*a* faces any one of the inclined surfaces 21*b,* then the former contacts the latter and allows the toner container 20 to be smoothly introduced into the mount portion.

If desired, the stop 57 may be formed independently of the side wall 47. In such a case, the stop 57 will be pivotally mounted on the apparatus body and constantly biased toward the box 21, but prevented from rotating over the expected stop position. The stop 57 formed integrally with the side wall 47 is advantageous over such an alternative configuration because it does not need an extra spring or an extra stop.

Figure 7:
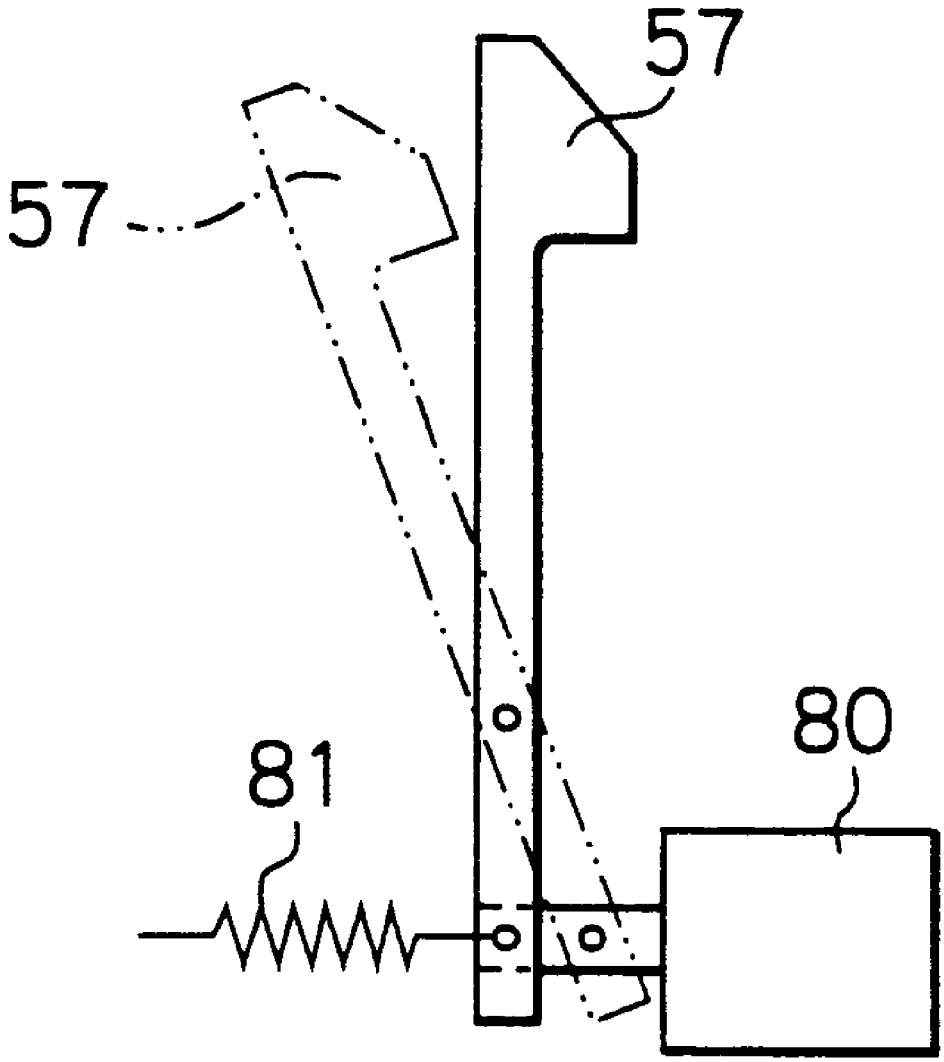
FIG. 7 is a view showing another specific configuration of the stop.

FIG. 7 shows a specific configuration of the stop 57 formed independently of the side wall 47. As shown, a solenoid 80 pulls the stop 57 from a locking position (solid line) to an unlocking position (phantom line) when turned on. Specifically, when the operator touches a preselected button, not shown, the solenoid 80 is turned on to pull the stop 57 to the unlocking position against the action of a spring 81. Alternatively, a toner end signal representative of the empty state of the toner container 20 may automatically turn on the solenoid 80. Further, a motor or similar drive source may be used to move the stop 57 from the locking position to the unlocking position via a cam.

In the illustrative embodiment, to frame the box 21, a single resin molding is folded at resin hinges in the same manner as paper folding. Therefore, when the empty toner container 21 is collected, the box 21 can be separated from the bag 22 and then developed in a single sheet and conveyed. This noticeably reduces the collection cost of the toner container 20.

Figure 8:
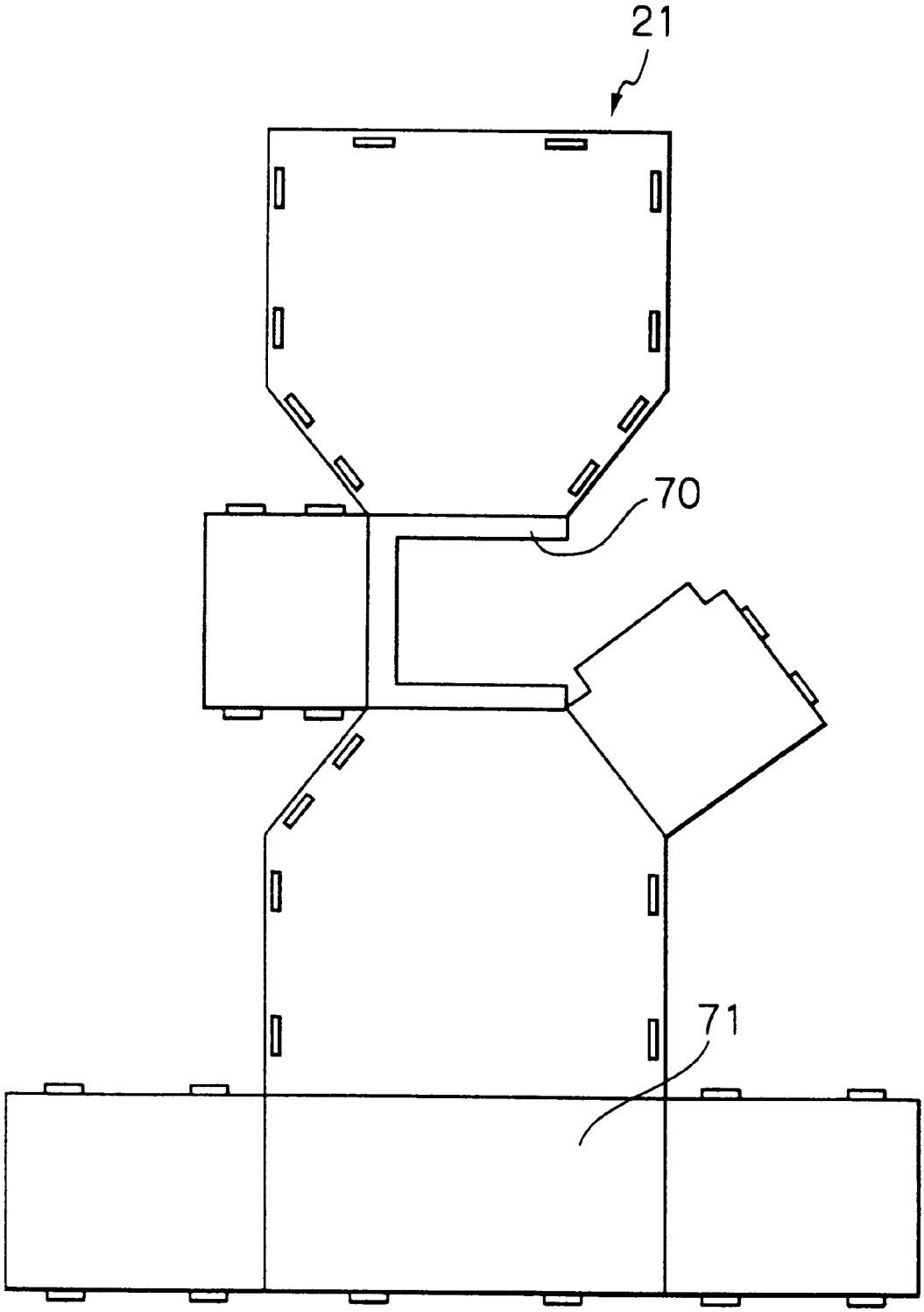
FIG. 8 is a view showing the toner container in a developed position.

The spring 63 causes the box 21 to hop up, as stated earlier. This, however, brings about a problem that loads act on the bottom of the box 21 contacting the spring 62 and the top contacting the stop 57, causing the top and bottom to collapse. This is likely to obstruct the accurate setting of the toner container 20. In light of this, as shown in FIG. 8, the top 71 and the bottom 70 of the box 21 expected to contact the stop 57 and spring 63, respectively, each are configured to adjoin three other faces of the box 21. That is, the top 71 and bottom 70 each are separate from the other faces only at one side thereof. In this condition, the top 71 and bottom 70 attain mechanical strength great enough to cope with the collapse.

Second Embodiment

Figure 9:
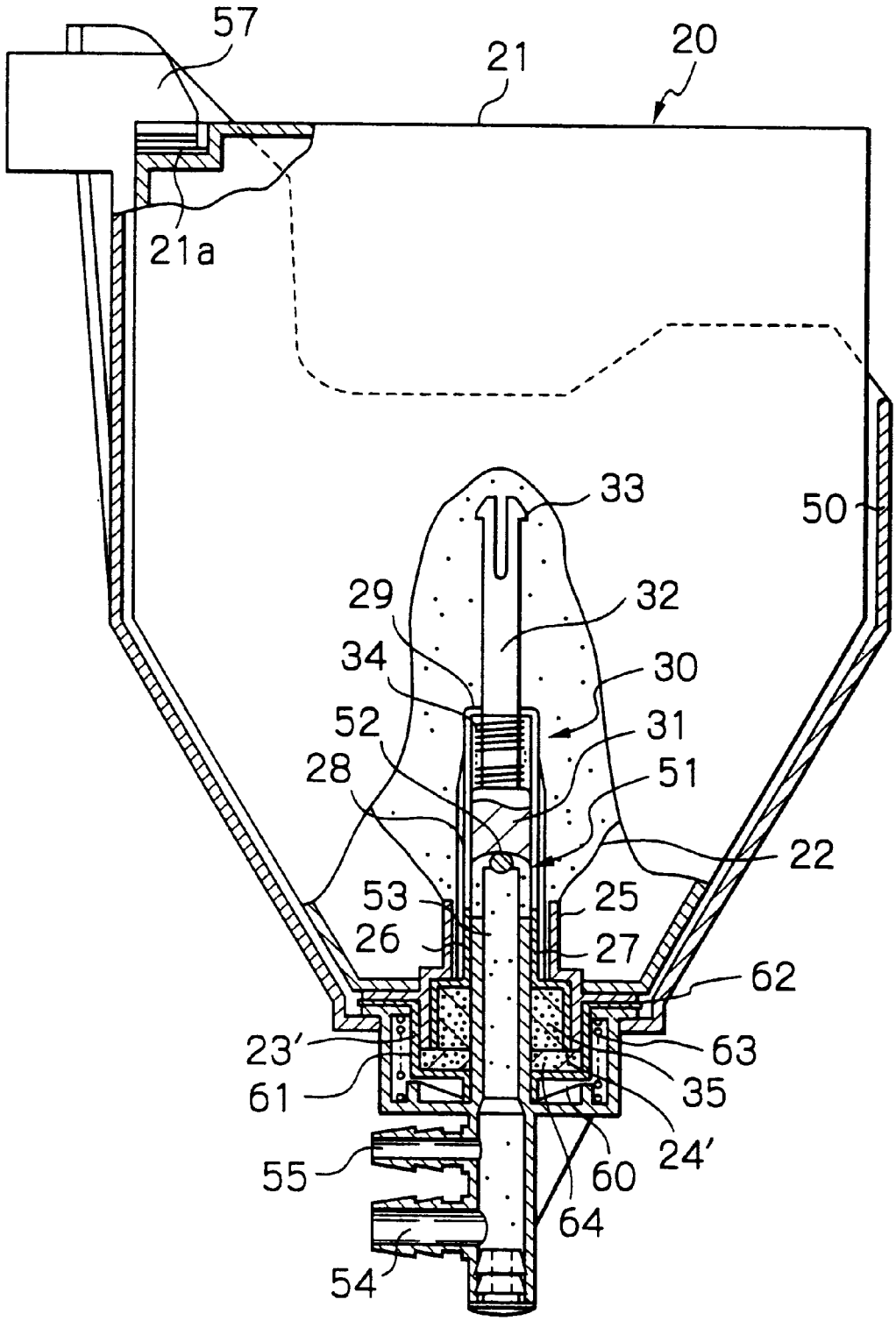
FIG. 9 is a view showing a second embodiment of the present invention.

Reference will be made to FIG. 9 for describing an alternative embodiment of the present invention. As shown, an outer mouth member 23' and an inner mouth member 24' are affixed to the bottom center of the bag 22, constituting a mouth portion. The mouth members 23' and 24' are formed of polyethylene, nylon or similar resin and adhered to each other.

The outer mouth member 23' and inner mouth member 24' respectively include sleeve portions 25 and 26 extending upward at the center. The sleeve portion 25 surrounds the sleeve portion 26 in a double wall structure. The bag 22 is adhered or otherwise affixed to the sleeve portion 24'. A toner outlet passage 27 extends throughout the sleeve 26. Shutter means, which plays the role of a self-closing valve, 30 is arranged in the toner outlet passage 27. While the two mouth members 23' and 24' may be molded integrally with each other, such a molding would make it difficult to fill the bag 22 with toner via the passageway 27 due to the shutter means 30. In the illustrative embodiment, the bag 22 is filled with toner before the mouth member 24' is adhered to the mouth member 23'. Subsequently, the mouth member 24 supporting the shutter means 30 is affixed. This procedure allows the bag 22 to be packed with toner in a desirable manner without being obstructed by the shutter means 30.

Figure 10:
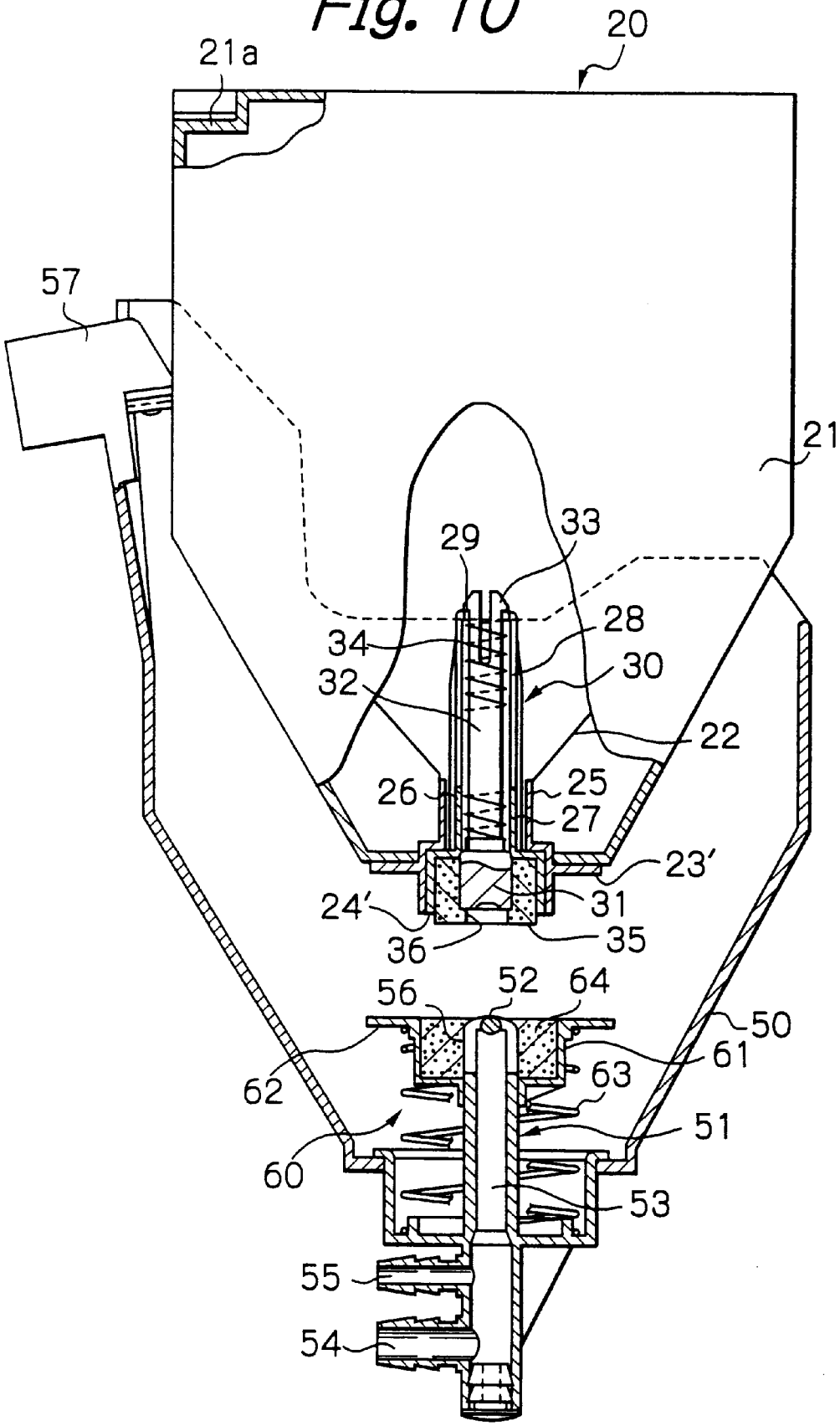
FIG. 10 is a view showing a toner container included in the second embodiment is released from amount portion.

The shutter means 30 includes a piston 31 movable back and forth in the axial direction of the toner outlet passage 27. A piston rod 32 is formed integrally with the piston 31 and extends upward. The upper end of the piston rod 32 terminates at a stop portion 33. A beam member 28 extends upward from the sleeve portion 26 of the inner mouth member 24'. The stop portion 33 is to be retained by an annular portion 29 at which the upper end of the beam member 28 terminates. A compression coil spring or resilient means 34 is retained by the piston 31 at one end and retained by the annular portion 29 at the other end. The spring 34 is wound round the piston rod 32 and constantly biases the piston 31 downward, so that the piston 31 is pressed against the nozzle 51. However, as shown in FIG. 10, when the toner container 20 hops up away from the nozzle 51, the stop 33 abuts against the annular portion 29.

The piston 31 is movable between a blocking position for blocking the toner outlet passage 27 and an unblocking position for unblocking it. Specifically, at the unblocking position, the nozzle 51 shown in FIG. 9 pushes up the piston 31 against the action of the spring 34 to thereby unblock the passage 27, as shown in FIG. 9. At the blocking position, the piston 31 blocks the passage 27, as shown in FIG. 10. At the blocking position, the circumferential surface of the piston 31 slidably contacts the seal member 35 fitted in the passage 27. The seal member 35 is formed of foam sponge or similar elastic material and has a tubular configuration. A hole 36 extends throughout the center of the seal member 35 and has a circular cross-section complementary to the contour of the nozzle 51.

Figure 11:
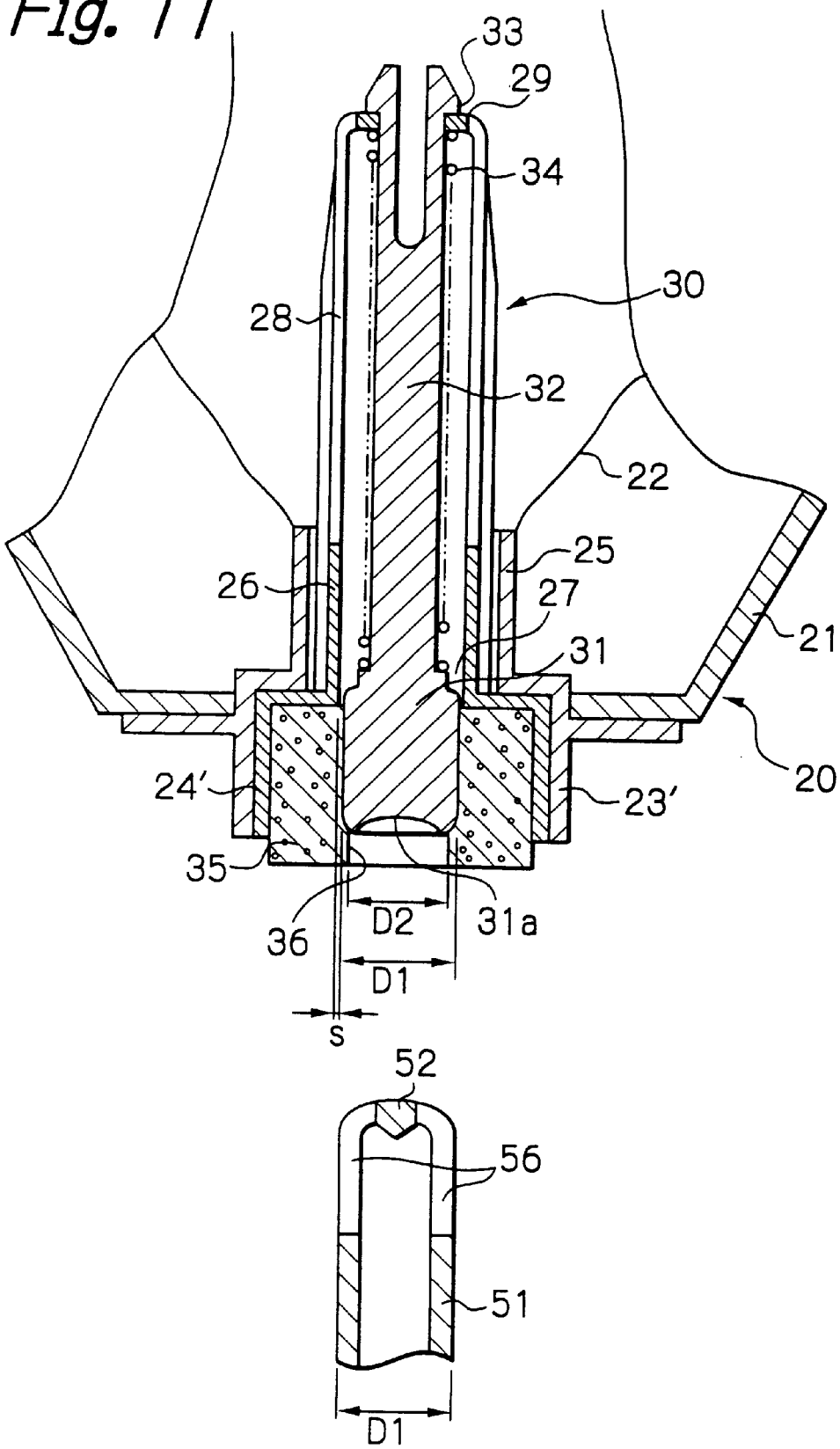
FIG. 11 is a fragmentary view showing shutter means included in the second embodiment in detail.

As shown in FIG. 11 in detail, assume that the piston 31 has a diameter D1, and that the through hole 36 has a diameter D2. Then, the diameter D1 is selected to be greater than the diameter D2. At the blocking position, therefore, the entire circumference of the piston 31 contacts the seal member 35. The nozzle 51 has a diameter equal to the diameter D1 of the piston 31. Assume that a gap s exists between the inside diameter of the sleeve portion 26 of the inner mouth member 24' and the circumference of the piston 31. Then, the gap s is selected to be 0.2 mm or above. This gap prevents the sleeve port on 26 from interfering with the movement of the piston 31.

The shutter means 30 selectively blocks the toner outlet passage 27 under the action of the spring 34, as stated above. Therefore, when the toner container 20 is pulled upward away from the nozzle 51, the shutter means 30 surely closes the passage 27 without regard to the environment, e.g., low temperature. At this instant, although the piston 31 slidingly contacts the seal member 35, the through hole 36 prevents the seal member 35 from partly tearing even when it is formed of sponge.

The piston 31 has a bottom 31*a* expected to face the top of the tip member 52 of the nozzle 51. The bottom 31*a* of the piston 31 and the top of the tip member 52 are so configured as to closely contact each other without any gap. Basically, the bottom 31*a* of the piston 31 and the top of the tip member 52 may be configured flat each. In the illustrative embodiment, the top of the tip member 52 and the bottom 31*a* of the piston 31 are configured convex and concave, respectively. It follows that the axis of the nozzle 51 can accurately coincide with the axis of the piston 31 even if slightly deviated from the latter when penetrated into the toner container 20.

Figure 12:
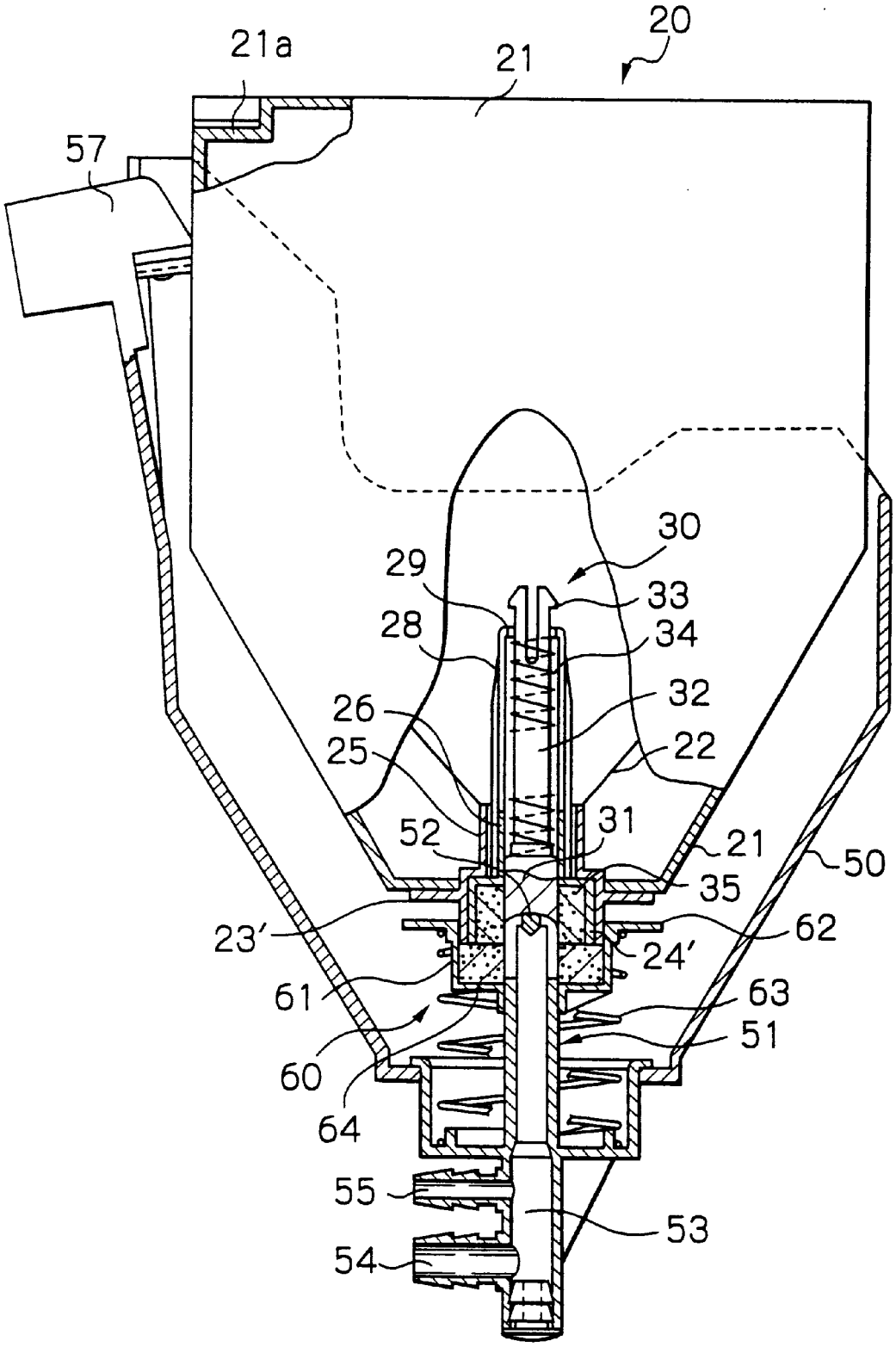
FIG. 12 is a view showing how the toner container of the second embodiment is released from the mount portion.

The configuration shown in FIG. 11 allows the piston 33 and nozzle 51 to surely align with each other and contact each other. Therefore, when the toner container 20 is released from the nozzle 51, the toner is prevented from leaking through the toner outlet passage 27. More specifically, as shown in FIG. 12, the nozzle 51 slidably contacting the seal member 35 moves away from the piston 31. At this instant, should the axis of the piston 33 and that of the nozzle 51 be not aligned, a gap temporarily appearing between the piston 31 and the seal 25 would cause the toner to leak. Further, in the illustrative embodiment, the bottom 31*a* of the piston 31 and the top of the tip member 52 closely contact each other. This prevents the toner otherwise entering a gap between the piston 31 and the tip member 52 from dropping.

The illustrative embodiment, like the previous embodiment, includes means for causing the toner container 20 to hop up away from the nozzle 51. Specifically, as shown in FIG. 9, the above means includes a movable support 61 having a generally U-shaped cross-section and formed with a flange 62 at its top. The spring 63 constantly biases the support 61 upward. A seal 64 formed of, e.g., sponge is fitted in the support 61 and adhered or otherwise affixed thereto. A slit is formed throughout the center of the seal 64 and assigned to the nozzle 51.

In the illustrative embodiment, the spring 63 is preloaded between the frame of the mount portion 50 and the support 61, constantly forcing the flange 62 of the support 62 upward. When the toner container 20 is absent in the mount portion 50, the spring 63 maintains the support 61 at its uppermost position shown in FIG. 10. The spring 63 has its length and biasing force so selected as to prevent the support 61 from slipping out of the nozzle 51.

As shown in FIGS. 9 and 10, in the illustrative embodiment, the stop 57 is formed integrally with the mount portion 50, which is assigned to each toner container 20. The mount portion 50 is formed of plastic or sheet metal, so that the stop 57 has a suitable degree of elasticity. Again, the stop 57 abuts against the bottom of the recess 21*a,* which is formed in the top of the box 21, thereby locking the toner container 20 at the set position.

In operation, when the operator accurately sets the toner container 20 in the mount portion 50, the toner container 20 compresses the spring 63. At this instant, the stop 57 elastically snaps onto the top of the box 21 to abut against the bottom of the recess 21*a,* locking the toner container 20 in the mount portion 50. To pull out the toner container 20, the operator releases the stop 57 from the top of the box 21. As a result, the springs 63 and 34 cause the toner container 20 to hop up, as shown in FIG. 10. In this condition, the toner container 20 is positioned at a higher level than the adjoining toner containers 20 and can therefore be easily pulled out.

The biasing force of the spring 63 will be described specifically hereinafter. The toner container 20 is pulled out of the apparatus body mainly when it has run out of toner, as stated earlier. The biasing force of the spring 63 therefore should only be intense enough to push up the empty toner container 20. At this instant, the biasing force of the spring 63 may fail to fully push up the toner container 20 alone. In the illustrative embodiment, the spring 34 of the shutter means 30 helps the spring 63 push up the toner container 20, obviating the above occurrence. Assume that resistance F acts on the seal member 35 when the toner container 20 is pushed up away from the nozzle 51, and that the toner container 20 has a weight M when empty. Then, the sum of the biasing force of the spring 63 and that of the spring 34 should only be greater than the sum of F and M. Also, assuming that the toner container N has a weight N when full, then the biasing force of the spring 63 can be smaller than the sum of F and N.

It is noteworthy that the illustrative with the seal member 35, in which the through hole 36 is formed, is practicable with far smaller resistance F than the previous embodiment. This further reduces the biasing force required of the spring 63.

In the first and second embodiments shown and described, the spring or biasing means 63 is mounted on the apparatus body. Alternatively, the spring 63 may be affixed to the toner container. The illustrative embodiments are practicable not only with the bag-in-box type toner container 20 made up of the bag 21 and box 22, but also with any other toner container having certain strength.

As stated above, the first and second embodiments have various unprecedented advantages, as enumerated below.

(1) The toner container mounted to the mount portion is caused to hop up when run out of toner. The toner container can therefore be easily mounted and dismounted from the mount portion. A minimum of biasing force is necessary to cause the toner container to hop up.

(2) The stop surely locks the toner container in the set position with a simple, inexpensive configuration.

(3) The stop does not interfere with the toner container being introduced into the mount portion. The toner container can therefore be smoothly set in the mount portion. In addition, the stop member can be easily released from the toner container.

(4) The toner container can be automatically moved away from the mount portion when run out of toner.

(5) The top and bottom of the box, which form part of the toner container, each adjoin other three faces when the box is developed in a single sheet. The top and bottom are therefore free from deformation ascribable to the loads of biasing means.

(6) The mouth of the toner container is surely closed by the spring. In addition, the force of the spring contributes to the hop-up of the toner container.

(7) The force of the resilient member included in the shutter means and that of the biasing means cooperate to surely move the toner container away from the mount portion.

Third Embodiment

Figure 13:
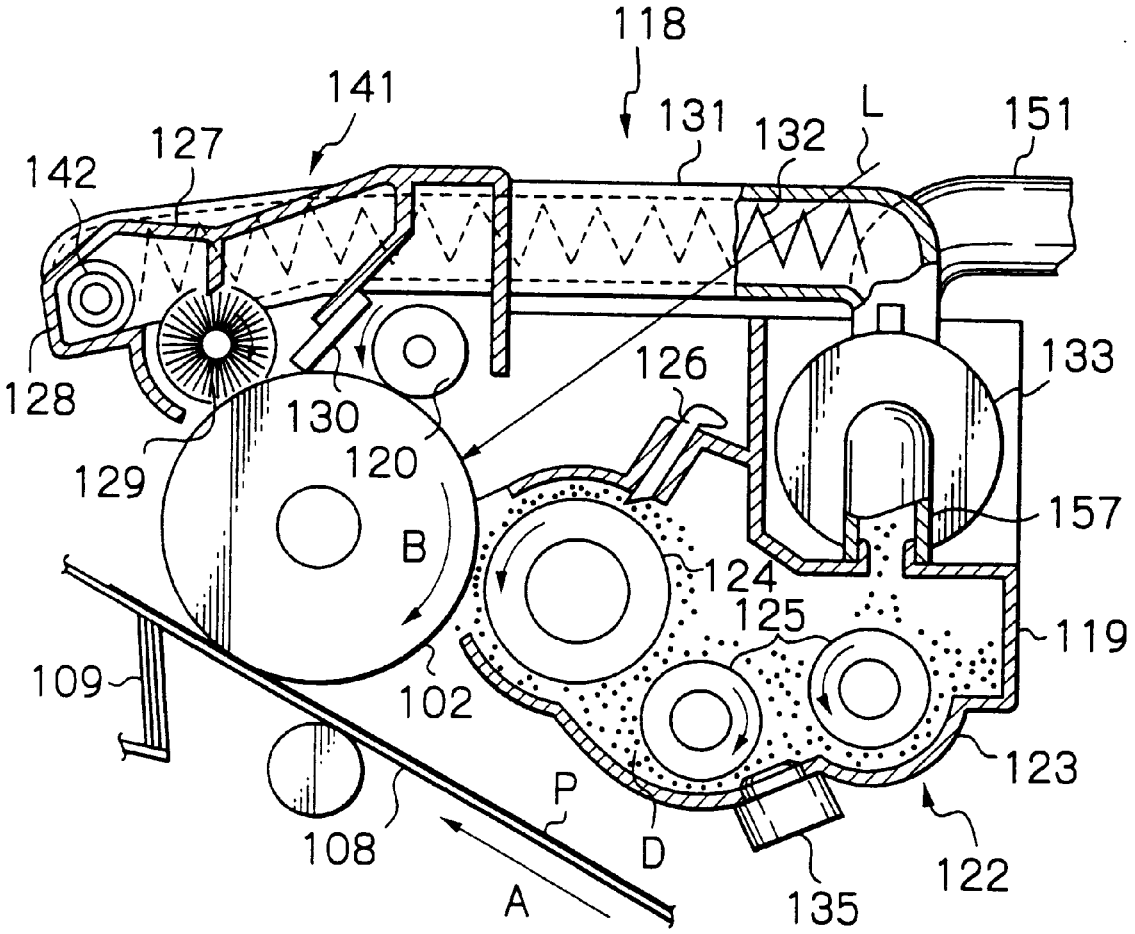
FIG. 13 is a view showing a third embodiment of the present invention.

This embodiment is mainly directed toward the second and third objects stated earlier. FIG. 13 shows the illustrative embodiment implemented as an image forming apparatus including a toner conveying pump. As shown, the illustrative embodiment includes a process cartridge 118 removably mounted to the apparatus body not shown. The process cartridge 118 includes a unit case 119. A photoconductive drum 102, which is a specific form of an image carrier, is rotatably mounted on the unit case 119. A drive mechanism, not shown, mounted on the apparatus body causes the drum 102 to rotate clockwise, as indicated by an arrow in FIG. 13. A charge roller, which is a specific form of a charger, 120 is also rotatably mounted on the unit case 119 and contacts the drum 102 while in rotation. The charge roller 120 uniformly charges the surface of the drum 102 to preselected polarity.

A laser writing unit, not shown, emits a laser beam L modulated in accordance with image data. The laser beam L scans the charged surface of the drum 102, thereby forming a latent image on the drum 102. In the illustrative embodiment, potential on the drum 102 decreases in portions scanned by the laser beam L, forming the latent image. The other portion of the drum 102 forms the background of the latent image. The laser writing unit is a specific form of an exposing unit.

A developing device 122 forming part of the process cartridge 118 develops the latent image with toner to thereby form a corresponding toner image. The developing device 122 includes a casing 123 formed by part of the unit case 119, a developing roller 124, and an agitator or agitating roller 125. The developing roller 124 and agitator 125 are rotatably mounted on the casing 123. The developing sleeve 124 is rotatable counterclockwise. The casing 123 stores a two-ingredient type developer D, i.e., a toner and carrier mixture. The two-ingredient type developer may be replaced with a one-component type developer or toner, if desired.

The agitator 125 agitates the developer D with the result that the toner and carrier are charged to opposite polarities by friction. The developing roller 124, to which a bias for development is applied, conveys the developer D deposited thereon while a metering blade 126 regulates the thickness of the developer D. Consequently, the developer D forming a layer on the developing roller 124 is brought to a developing position between the roller 124 and the drum 102. At the developing position, the toner of the developer D is transferred from the developing roller 124 to the drum 102, developing the latent image. A toner content sensor 135 is responsive to the toner content of the developer D existing in the casing 123. When the output of the toner content sensor 135 shows that the toner content is short, fresh toner is replenished to the casing 123, as will be described later specifically.

A sheet feeder is arranged in the apparatus body below the process unit 118. The sheet feeder feeds a paper sheet, resin sheet or similar recording medium P. A belt 108, which faces the drum 102 and rotates in a direction A, conveys the paper sheet P to an image transfer position between the drum 102 and the belt 108. An image transfer brush 109, which is a specific form of an image transferring device, is applied with a voltage opposite in polarity to the charge deposited on the toner. The brush 109 therefore transfers the toner image from the drum 102 to the paper sheet P. The brush 109 may, of course, be replaced with a roller, a blade or a corona discharger, if desired. The belt 108 further conveys the paper sheet P carrying the toner image thereon in the direction A. The paper sheet P left the belt 108 is routed through a fixing unit, not shown, to the outside of the apparatus body. The fixing unit fixes the toner image on the paper sheet P.

A drum cleaner 127 removes the toner left on the drum 102 after the image transfer. The drum cleaner 127 includes a casing 128 formed by part of the unit case 119, a brush 129, and a blade 130. The brush 129 is mounted on the casing 128 and rotatable in a direction indicated by an arrow. The blade 130 is affixed to the casing 128 at its base end. The brush 129 and blade 130 are held in contact with the drum 102 in order to scrape off the toner left on the drum 102.

The toner removed by the drum cleaner 127 is collected in the casing 128 and then conveyed to the developing device 122 by a toner conveying device 141. The developing device 122 again uses the toner returned thereto. The toner conveying device 141 includes a pipe 131 extending from the casing 128 to the developing device 122 and a toner conveying member 132, which is caused to rotate by a drive source not shown.

A screw 142 is disposed in the casing 128 and rotatable to convey the toner collected by the brush 129 and blade 130 to the pipe 131. The toner conveying member 132 in rotation conveys the toner brought to the pipe 131 to a toner conveying pump 133 through the pipe 131. The toner conveying pump 133 returns the toner conveyed thereto to the casing 123 of the developing device 122, as will be described later specifically.

When the toner content of the developer D existing in the casing 123 is determined to be short on the basis of the output of the toner content sensor 35, fresh toner is replenished to the developing device 122, as will be described hereinafter.

Figure 14:
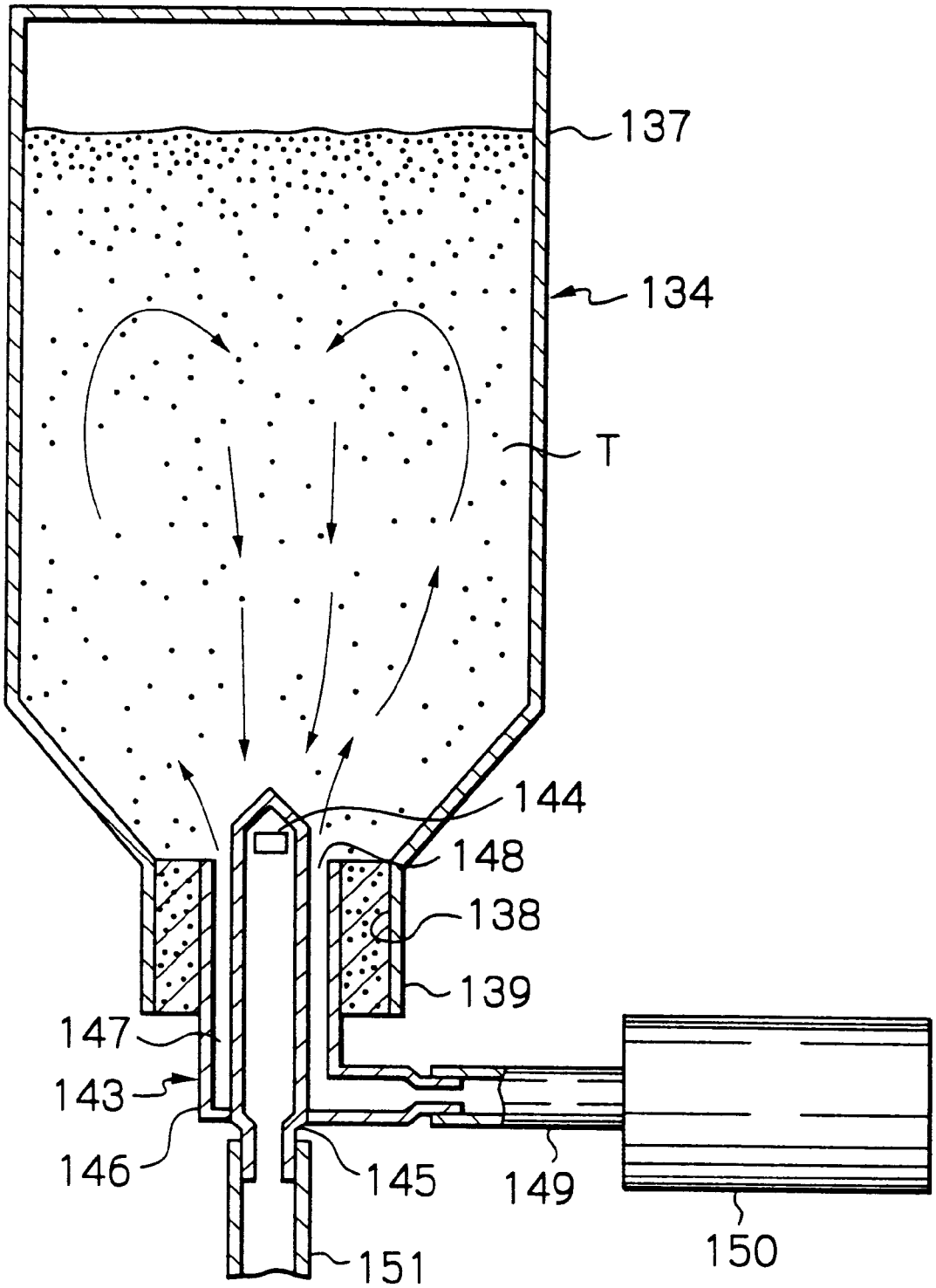
FIG. 14 is a view showing a toner container included in the third embodiment.

FIG. 14 shows a toner container 134 removably set in a preselected portion of the apparatus body remote from the process cartridge 118. As shown, the toner container 134 includes a container body 137 formed with a mouth 138 and a seal member 139 formed of a foam material and fitted in the mouth 138. The container body 137 is packed with powdery toner T.

The apparatus body includes a nozzle 143 having a double wall structure. Specifically, the nozzle 143 has a toner outlet pipe 145 and a nozzle pipe 146 affixed to the toner outlet pipe 145. An opening 144 is formed in one end of the toner outlet pipe 145 for admitting the toner T into the pipe 145. An annular air inlet passage 147 is formed between the toner outlet tube 145 and the nozzle tube 146. One end 148 of the nozzle tube 146 is open to the inside of the container body 137. A tube 149 provides communication between an air pump 150, which is mounted on the apparatus body, and the other end of the nozzle pipe 146. A tube 151 is connected at one end to the other end of the toner outlet tube 145.

Assume that the output of the toner content sensor 135, FIG. 13, shows that the toner content of the developer D in the developing device 122 is short. Then, the air pump 150 is caused to feed air under pressure to the nozzle pipe 146 via the tube 149. Air is then sent from the nozzle pipe 146 to the container body 137 via the air passage 147 and air outlet 148, as indicated by arrows in FIG. 14. Air flows in the container body 137 while fluidizing the toner T and raising pressure inside the container body 137. The raised pressure inside the container body 137 delivers the fluidized toner T to the outside of the toner container 134 via the toner outlet pipe 145 in cooperation with the toner conveying pump 133, FIG. 13. Subsequently, the toner T is conveyed through the tube 151 to the toner conveying pump 133 together with air.

Figure 15:
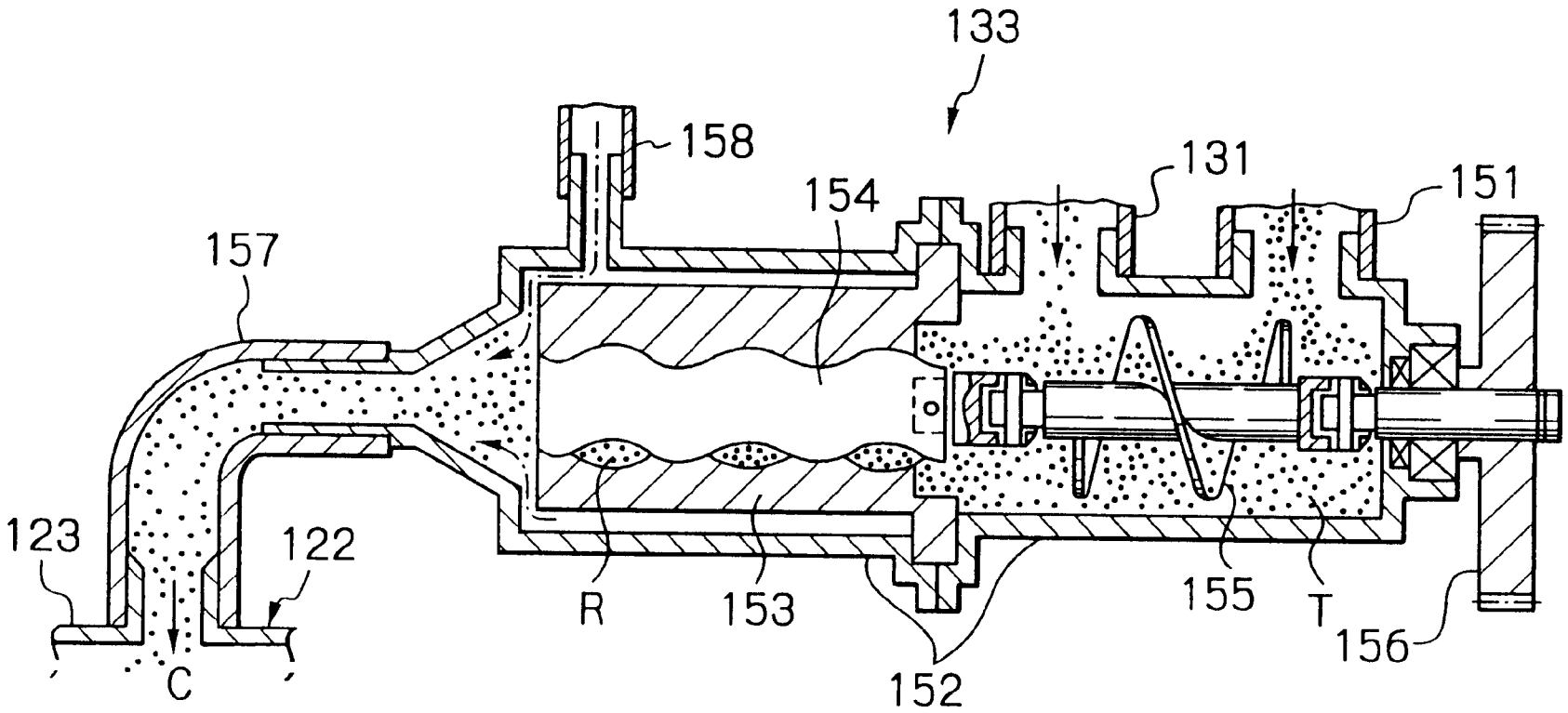
FIG. 15 is a view showing a toner conveying pump also included in the third embodiment.

FIG. 15 shows a specific configuration of the toner conveying pump 133. As shown, the pump 133 includes a hollow tubular stator 153 and a single axis, eccentric rotor 154 rotatably disposed in the center bore of the stator 153. A spiral groove (two spiral grooves in the illustrative embodiment) is formed in the inner periphery of the stator 153. The rotor 154 resembles a male screw. The stator 153 is fixed in place within a casing 152 and formed of rubber or similar elastic material or a rigid material. The rotor 154 spirally extends throughout the stator 153 in such a manner as to form a space R for conveying the toner. The rotor 154 has a circular cross-section in any plane. The center of the circular cross-section is offset from the axis of the rotor 154 and spirally extends around the axis in the axial direction. Consequently, the space R for the toner is formed between the outer circumference of the rotor 154 and the inner circumference of the stator 153. The stator 153 contacts the rotor 154 in such a manner as to embrace the rotor 154 and is fixed in place. The pump 133 is identical in basic configuration with a conventional powder pump referred to as a single axis, eccentric screw pump, a screw pump or a Morno pump.

A screw conveyor 155, which is rotatably positioned in the casing 152, is connected at one end to the rotor 154. A gear 156 is mounted on the other end of the screw conveyor 155. The tube 151, FIG. 14, is connected to an opening formed in the casing 152. The tube 131, FIG. 13, is connected to another opening also formed in the casing 152.

Again, assume that the toner content of the developer D in the developing device 122 becomes short, as sensed by the toner content sensor 135. Then, the gear 156 of the toner conveying pump 133 starts rotating at the same time as the air pump 150, FIG. 14 starts rotating. The gear 156 causes the screw conveyor 155 and rotor 154 to start rotating. Consequently, the toner T delivered to the casing 152 is driven into the space R between the rotor 154 and the stator 153. The rotor 154 in rotation causes the space R to move from the right to the left, as viewed in FIG. 15. The resulting suction pressure conveys the toner T from the right to the left, as viewed in FIG. 15. As a result, the toner T is replenished to the casing 123 of the developing device 122 via a pipe 157 (see FIG. 13 as well) connected to the casing 152. At this instant, the collected toner conveyed to the casing 152 via the pipe 131 is also delivered to the casing 123 together with the fresh toner.

If desired, compressed air may be introduced into the casing 152 via an air inlet port 158 in order to further fluidize the toner T brought to the casing 152.

The operation described above ends in a preselected period of time and then repeated later every time the toner content of the developer D becomes short. As a result, the toner content of the developer D in the developing device 122 is maintained constant. Air delivered to the developing device 122 together with the toner is discharged via a filter, not shown, fitted on the casing 123.

While the toner conveying pump 133 conveys the toner in the previously stated manner, the toner is heavily compressed in the space R between the rotor 154 and the stator 153 and subjected to heavy stress. This, coupled with frictional heat derived from the sliding contact of the rotor 154 with the stator 153, is apt to cause the toner to cohere in the form of a number of lumps. The lumps form the previously stated small toner spots and blank portions therearound in the resulting image and thereby degrade image quality.

In light of the above, in the illustrative embodiment, the rotor 154 is formed of aluminum, stainless steel or similar metal having high thermal conductivity. This allows frictional heat ascribable to the frictional contact of the rotor 154 and stator 153 to be radiated to the outside of the pump 133 via the rotor 154 at an early stage of operation. It follows that the toner being conveyed is heated little and does not form any lump or forms a minimum number of lumps. Consequently, the small toner spots and blank portions are obviated or reduced in a toner image transferred to the paper sheet P, FIG. 13. This is contrastive to a conventional rotor that is usually formed of resin in order to reduce cost.

While the rotor 154 formed of metal having high thermal conductivity is desirable from the heat radiation standpoint, it must be formed by cutting a metallic material and therefore needs an extra cost. In an alternative configuration, to reduce the cost, the rotor 154 is made up of a core formed of polycarbonate resin, ABS resin or similar resin and a layer of nickel or similar metal having high thermal conductivity and coating the core. The core implemented as a resin molding is easier to machine and therefore lower in cost than a metallic rotor. Further, the metallic coating covering the core promotes the radiation of heat ascribable to the sliding contact of the rotor 154 and stator 153 to the outside of the toner conveying pump 133 at an early stage of operation. This is successful to achieve the various advantages stated earlier without increasing the cost of the toner conveying pump 133.

Alternatively, the rotor 154 may be formed of resin containing silicone oil or similar lubricant. The lubricant reduces the coefficient of friction between the stator 153 and the rotor 154 and thereby allows the rotor 154 to smoothly slide on the stator 153 while generating a minimum of heat. This is also successful to reduce the small toner spots and blank portions therearound in a toner image ascribable to the lumps of toner.

The toner conveying pump 133 is applicable to the image forming apparatus described with reference to FIGS. 13 through 15 for surely enhancing the quality of a toner image transferred to a paper sheet.

The illustrative embodiment is applicable to a broad range of image forming apparatuses including the apparatus shown and described. Also, the structure of the toner conveying pump shown and described is only illustrative. For example, the toner conveying pump is similarly applicable to an image forming apparatus of the type including an intermediate image transfer body via which a toner image is transferred from a photoconductive element to a paper sheet. Further, the toner conveying pump may be implemented as a pump for conveying toner collected from a photoconductive element to a developing device.

As stated above, the illustrative embodiment has various unprecedented advantages, as enumerated below.

(1) The rotor formed of metal having high thermal conductivity promotes heat radiation and prevents toner being conveyed by the toner conveying pump from being heated. This prevents the toner from cohering in the form of lumps.

(2) The metallic coating layer covering the core of the rotor promotes heat radiation and also allows the above advantage (1) to be achieved. In addition, the core formed of resin is low cost.

(3) The rotor is formed of resin containing a lubricant and can therefore smoothly slide on the stator, so that heat ascribable to the sliding contact of the rotor and stator is reduced. This is also successful to achieve the advantage (1).

(4) The toner free from lumps enhances the quality of a toner image transferred to a paper sheet.

Various modifications will become possible for those skilled in the art after receiving the teachings of the present disclosure without departing from the scope thereof.

What is claimed is:

1. An image forming apparatus, comprising:

a body;

a mount portion included in said body and configured to mount a toner container storing toner from above said mount portion;

releasing means for releasing the toner container from a position where said toner container is set in said mount portion; and biasing means for constantly biasing the toner container upward, said biasing means supported by said mount portion, the biasing means exerting a force insufficient to change a position of a toner container completely filled with toner.

2. The apparatus as claimed in claim 1, wherein said biasing means comprises resilient biasing means mounted on said apparatus.

3. The apparatus as claimed in claim 1, wherein a nozzle is mounted on said body in such a manner as to penetrate into the toner container, and assuming that resistance F acts when the toner container is moved away from said nozzle, and that said toner container has a weight M when empty, said biasing means exerts a biasing force greater than a sum of F and M.

4. The apparatus as claimed in claim 3, wherein assuming that resistance F acts when the toner container is moved away from said nozzle, and that said toner container has a weight N when full, said biasing means exerts a biasing force smaller than a sum of F and N.

5. The apparatus as claimed in claim 1, further comprising locking means for locking the toner container set in said mount portion against an action of said biasing means.

6. The apparatus as claimed in claim 5, wherein said locking means comprises a stop included in said body in such a manner as to abut against the toner container.

7. The apparatus as claimed in claim 6, wherein said stop is formed integrally with a side wall included in said mount portion.

8. The apparatus as claimed in claim 6, wherein said stop is movable between a locking position for locking the toner container due to elasticity of said stop and an unlocking position for unlocking said toner container.

9. The apparatus as claimed in claim 6, wherein said stop includes a tapered surface in an upper portion that faces the toner container when said toner container is set in said mount portion, said tapered surface approaching said toner container downward.

10. An image forming apparatus, comprising:

a mount portion configured to mount a toner container storing toner;

a biasing means for constantly biasing the toner container upwards, said biasing means supported by said mount portion, the biasing means exerting a force insufficient to change a position of a toner container completely filled with toner;

a stop engageable with the toner container and configured to lock said toner container set in said mount portion against an action of a biasing means; and moving means for selectively moving said stop between a locking position for locking the toner container and an unlocking position for unlocking said toner container.

11. The apparatus as claimed in claim 10, wherein said moving means moves said stop from the locking position to the unlocking position in response to a toner end signal representative of an empty state of the toner container.

12. A toner container device storing toner, comprising:

a toner container configured to removably mount to a mount portion included in an image forming apparatus, said toner container is mounted to said mounted portion from above and released from said mount portion upward; and biasing means for constantly biasing said toner container upward, the biasing means exerting a force insufficient to change a position of a toner container completely filled with toner.

13. The toner container device as claimed in claim 12, comprising:

a deformable bag storing the toner; and a box accommodating said bag and more rigid than said bag;

wherein said box has a top and a bottom, in a direction of mounting, each adjoining other three faces when said box is developed in a single sheet.

14. An image forming apparatus including a mount portion for allowing a toner container, which stores toner, to be removably mounted from above for thereby replenishing said toner to a developing device, said image forming apparatus comprising:

a nozzle extending upward from the mount portion;

shutter means included in the toner container and closed by a resilient member that exerts a force outward of said toner container; and pushing means for pushing the toner container set in the mount portion upward;

wherein the force of said resilient member is used as a biasing force of said pushing means, the force being insufficient to change a position of a toner container completely filled with toner.

15. The apparatus as claimed in claim 14, wherein said pushing means comprises biasing means for constantly biasing the toner container upward, and assuming that resistance F acts when the toner container is moved away from said nozzle, and that said toner container has a weight M when empty, a sum of the biasing force of said biasing means and the force of said pushing means is greater than a sum of F and M.

16. An image forming apparatus, comprising:

a body;

a mount portion disposed within said body and configured to mount a toner container storing toner from above said mount portion;

a release member configured to release the toner container from a position where said toner container is set in said mount portion; and a biasing member supported by said mount portion and configured to constantly bias the toner container upward, the biasing member exerting a force insufficient to change a position of a toner container completely filled with toner.

17. The apparatus as claimed in claim 16, wherein said biasing member comprises a resilient member mounted on said apparatus.

18. The apparatus as claimed in claim 16, wherein a nozzle is mounted on said body in such a manner as to penetrate into the toner container, and assuming that resistance F acts when the toner container is moved away from said nozzle, and that said toner container has a weight M when empty, said biasing member exerts a biasing force greater than a sum of F and M.

19. The apparatus as claimed in claim 18, wherein assuming that resistance F acts when the toner container is moved away from said nozzle, and that said toner container has a weight N when full, said biasing member exerts a biasing force smaller than a sum of F and N.

20. The apparatus as claimed in claim 16, further comprising a locking member configured to lock the toner container set in said mount portion against an action of said biasing member.

21. The apparatus as claimed in claim 20, wherein said locking member comprises a stop disposed within said body in such a manner as to abut against the toner container.

22. The apparatus as claimed in claim 21, wherein said stop is formed integrally with a side wall included in said mount portion.

23. The apparatus as claimed in claim 21, wherein said stop is movable between a locking position for locking the toner container due to elasticity of said stop and an unlocking position for unlocking said toner container.

24. The apparatus as claimed in claim 21, wherein said stop includes a tapered surface in an upper portion that faces the toner container when said toner container is set in said mount portion, said tapered surface approaching said toner container downward.

* * * * *